United States Patent [19]

Stalder

[11] 4,058,964

[45] Nov. 22, 1977

[54] OPEN-END ROTOR FOR A SPINNING MACHINE

[75] Inventor: Herbert Stalder, Winterthur, Switzerland

[73] Assignee: Rieter Machine Works, Ltd., Winterthur, Switzerland

[21] Appl. No.: 673,355

[22] Filed: Apr. 5, 1976

[30] Foreign Application Priority Data

Apr. 11, 1975 Switzerland ..... 4636/75

[51] Int. Cl.[2] ..... D01H 1/12

[52] U.S. Cl. ..... 57/58.89

[58] Field of Search ..... 57/58.89–58.95

[56] References Cited

U.S. PATENT DOCUMENTS

| | | | |
|---|---|---|---|
| 3,163,976 | 1/1965 | Juillard | 57/58.89 |
| 3,439,487 | 4/1969 | Landwehrkamp et al. | 57/58.89 |
| 3,440,812 | 4/1969 | Stary et al. | 57/58.89 |
| 3,481,128 | 12/1969 | Landwehrkamp et al. | 57/58.89 |
| 3,789,597 | 2/1974 | Schon | 57/58.89 |
| 3,812,667 | 5/1974 | Marsalek et al. | 57/58.89 |

*Primary Examiner*—John Petrakes

*Attorney, Agent, or Firm*—Kenyon & Kenyon, Reilly, Carr & Chapin

[57] ABSTRACT

The fiber collecting groove is located at the largest inside diameter of the rotor and is formed by two surfaces which define an angle of aperture $\alpha$ from 45° to 90°. The bottom of the groove is of a radius of from 0.1 to 0.5 millimeters. Also, the bisector of the angle of aperture $\alpha$ forms an angle $\beta$ with the plane of rotation of the groove of a value from 0° to 45° while the yarn take-off direction forms an angle with the plane of rotation of from 0° to 25°.

Trash accumulations are reduced to a minimum without detrimentally effecting yarn quality.

13 Claims, 5 Drawing Figures

OPEN-END ROTOR FOR A SPINNING MACHINE

This invention relates to an open-end rotor for a spinning machine.

As is known, open-end spinning machines generally employ rotors with a fiber collecting groove in order to spin delivered fibers into yarn. It is also known to deliver the fibers to these rotors via an air stream. However, fibers which are delivered into a rotor by an airstream always contain a portion of fine contaminants, such as dust and the like, which adhere to the rotor and particularly to the fiber collecting groove. These contaminants eventually fill up the groove in such manner that the geometrical groove shape changes with time. As a result, the yarn formation process is progressively impaired until becoming impossible and thread breakages occur.

Rotors are known in which the supplied fibers are deposited into a fiber collecting groove provided at the position of the largest inside diameter of the rotor and are withdrawn from this groove as a twisted yarn. In most cases, the fiber collecting groove is V-shaped and has an angle of aperture which roughly ranges from 30° to 130° while the groove bottom radius ranges from 0.1 to 2.0 millimeters. During use, the deposited fibers form a loose sliver in the V-shaped groove of an approximately triangular cross-section. In this arrangement, according to the inclination of the bisector of the angle defined by the groove surfaces with respect to the plane of rotation of the groove, a triangular sliver is generated with very different legs.

A spinning rotor is also known as described in U.S. Pat. No. 3,812,667 in which a yarn twisted from a flat sliver during formation is first rolled off over a longer zone on the outer limiting wall of the groove and does not leave the groove directly in the direction of a yarn take-off tube. If the fibers or the sliver, respectively, are "rolled in" into a yarn in such a manner, deposition of trash in the rotor groove can be reduced to some extent. This induces the disadvantage, however, that at higher yarn take-off speeds, yarn quality is impaired. Furthermore, a flat sliver presents more resistance against the twisting-in. Also, a loose mutual contact prevails between the individual fibers. The finest trash particles, such as dust, which have been supplied into the rotor together with the fibers, are twisted in partially only if such a flat sliver is twisted. That is, these particles remain in the rotor groove and eventually fill up the groove. In addition, the fibers are deposited into a flat sliver in a more or less random arrangement. This causes the formed yarn to be bulky and results in a quality reduction.

Spinning rotors are also known wherein the yarn is deflected in the rotor (U.S. Pat. No. 3,481,128). These rotors have the advantage that the deflection of the yarn between the point or origin, i.e., the fiber collecting groove, and the yarn take-off tube, allows the tube to be taken off at higher speeds. The quality remains the same because, at the point of deflection, an additional force acts upon the yarn which generates an additional momentum at the point of yarn formation, i.e., at the groove and increases the yarn take-off tension.

Unfortunately, in this arrangement, severe trash deposition occurs all the same. This is due to the fact that if the yarn is deflected, the yarn being formed can no longer roll off on an adjacent limiting wall. Also, twisting in of the flat sliver occurs in the region of the fiber collecting groove, where the yarn take-off also takes place. Twisting in of a flat sliver directly in the groove furthermore requires a higher torsional momentum than twisting in of a sliver of a lower moment of inertia, e.g. a sliver of triangular cross-section with equal sides.

Rotors also have been proposed as described in U.S. Pat. No. 3,440,812 in which the inside limiting wall of the yarn collecting groove forms a very small angle of less than 45° with the outer limiting wall of the groove while the bisector of the groove angle forms a large angle of more than 45 degrees with the plane of rotation. This arrangement also tends to cause severe trash accumulation in the groove bottom, such that, as mentioned, the geometrical shape changes with time and such that the yarn quality diminishes. If the angle of aperture of the groove is small and if the groove bottom radius is small, "jamming" of the deposited fiber sliver occurs. The friction at the walls is increased in such manner that twisting in of the fiber sliver into a yarn is rendered more difficult and negative changes in the spinning process in the rotor occur. Such changes occur, e.g. in the impaired propagation from the yarn into the fiber sliver in the groove. The fiber sliver, thus, is lifted off the groove immediately after twisting occurs. This also causes separation of the impurities from the incompletely twisted fiber sliver under the influence of centrifugal force such that the impurities remain in the groove.

If the groove radius is enlarged in the arrangement described above in order to substantially enlarge the groove and thus to prevent the "jamming", the fibers are deposited as a flat sliver on the outer surface of the groove. The same problems of twisting in a flat sliver thus occur as already described earlier. Additionally, the severest trash depositions occur in this geometrical formation of the groove. This can be explained by the migration of the trash particles under the influence of centrifugal force from the flat fiber sliver towards the groove where the particles are deposited and are not twisted in.

Accordingly, it is an object of the invention to lay out a fiber collecting groove of a rotor in such a manner that accumulations of trash in the fiber collecting groove are reduced to a minimum without detrimentally influencing the spinning conditions and the yarn quality.

Briefly, the invention provides a rotor for an openend spinning machine where the rotor has a cavity or space concentrically disposed about a rotational axis and a pair of annular intersecting surfaces within the cavity which define a fiber collecting groove at the largest inside diameter of the cavity. The two groove surfaces define a first angle of aperture of from 45 to 90° and have a rounded groove bottom of a radius of from 0.1 to 0.5 millimeters therebetween. In addition, a second angle between a straight line bisecting the angle of aperture and a plane of rotation of the groove is of a value from 0° to 45° while a third angle between the plane of rotation and a yarn take-off direction from the groove is of a value from 0 to 25°.

The rotor is placed in combination with a cover which has a yarn take-off tube projecting into the rotor cavity coaxially of the axis of rotation.

The rotor may also be formed with a portion which defines a peripheral edge on which the yarn taken-off from the groove can deflect before passing through the take-off tube. Also, the take-off tube may project into the cavity a distance sufficient to deflect the yarn over a peripheral edge of one of the groove surfaces.

These and other objects and advantages of the invention will become more apparent from the following detailed description and appended claims taken in conjunction with the accompanying drawings in which:

FIGS. 1 and 2 each illustrate a partial cross-sectional view of known spinning rotors;

Figure 1:
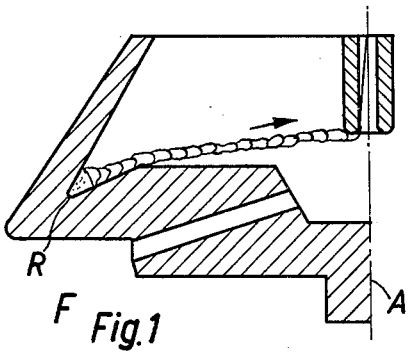

Referring to FIG. 1, the geometrical arrangement of a known rotor groove according to U.S. Pat. No. 3,440,812 is shown. Such a rotor groove is suggested for processing staple fibers of up to about 60 millimeters staple length. The fiber sliver in this arrangement is placed in a deep V-shaped groove slightly inclined towards the plane of rotation with a small angle of aperture about 35° and with a small groove radius R of about 0.2 millimeters. As a result, the fiber sliver is jammed in a narrow wedge-shaped incision.

Figure 2:
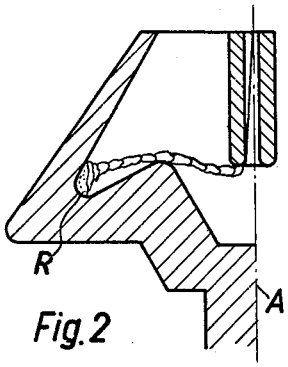
Figure 4:
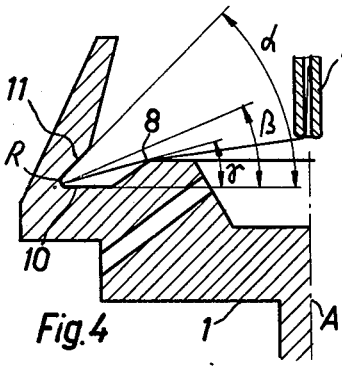
FIG. 4 illustrates a partial cross-sectional view of a rotor wherein one groove surface is horizontal in accordance with the invention.

Referring to FIG. 2, a similar groove to that of FIG. 1 is shown as known from U.S. Pat. No. 3,481,128 (FIG. 4). This groove has a large groove radius R of about 0.8 millimeters. The fiber sliver is very flat and, due to the action of centrifugal force, is placed onto the outer limiting wall of the rotor.

Figure 3:
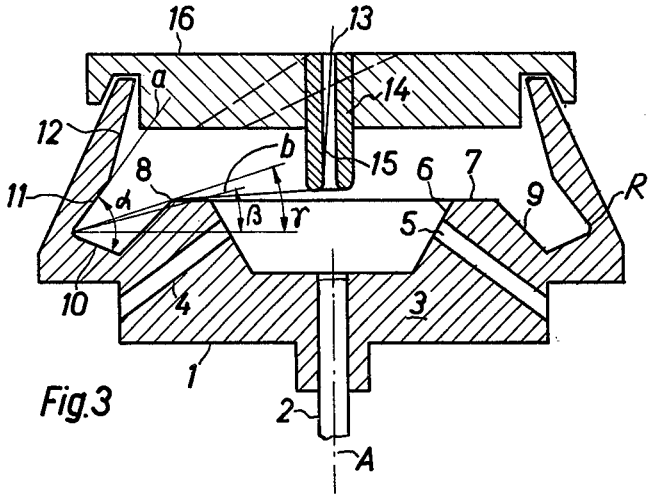
FIG. 3 illustrates a cross-sectional view of a spinning rotor of a first embodiment according to the invention.

Referring to FIG. 3, a rotor 1 according to the invention is shown which is suitable for spinning staple fibers of the cotton staple type and which is supported by and rotatingly driven by a shaft 2 about a vertical axis of rotation. This rotor 1 has a base body 3 which defines a cavity or space open to the upper side of the rotor 1. In addition, ventilation ducts 4 are provided each of which merges into an opening 5 at the cavity namely in a conical surface 6 inclined with respect to a horizontal plane. This conical surface 6 is formed by an annular conical projection of the body 3 within the cavity. The projection has a flat horizontal annular surface 7 which forms an outer peripheral edge 8 with an outer conical surface 9 of the projection.

The rotor 1 also has a fiber collecting groove defined by a pair of annular intersecting surfaces 10, 11 within the cavity, the groove being located at the largest inside diameter of the cavity. As shown, the conical surface 9 of the projection forms a conical flange for the inner groove surface 10 while the outer groove surface 11 which is conical merges into a sliding wall 12. A rounded groove bottom is located between the two groove surfaces 10, 11 and is of a radius R of about 0.2 millimeters.

The two groove surfaces 10, 11 define an angle of aperture $\alpha$ of 75°. This angle $\alpha$ is illustrated between a straight line *a* extending from the groove surface 11 and the inner groove surface 10. A straight line *b* representing the bisector of the angle of aperture $\alpha$ forms an angle $\beta$ with the plane of rotation of the fiber collecting groove (as represented by the flat surface 7) of about 15°. This angle $\beta$ is a measure of the groove inclination with respect to a horizontal plane. In addition, the angle $\gamma$ under which a yarn is taken off from the groove is measured between the plane of rotation and the yarn take-off direction from the groove. The angle $\gamma$ is 17°.

As shown, the rotor 1 is used in combination with a cover 16 which has a yarn take-off tube 14 projecting into the rotor cavity coaxially of the axis of rotation of the rotor. The tube 14 includes a bore 15 for passage of a freshly spun yarn 13 and protrudes into the cavity a distance sufficient to deflect the yarn 13 slightly on the peripheral edge 8.

Referring to FIG. 4, wherein like reference characters indicate like parts as above, the inner collecting groove surface 10 may alternatively be arranged at right angles to the rotor axis. In addition, the groove radius R is 0.2 millimeters, the groove aperture angle $\alpha$ is 45°, the groove inclination angle $\beta$ is 22.5°, and the yarn take-off angle $\gamma$ is 17°.

Figure 5:
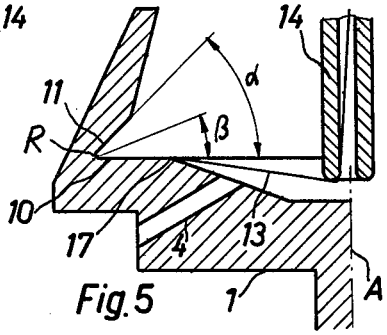
FIG. 5 illustrates a partial cross-section of a rotor used with a take-off tube which projects through the plane of rotation of the groove.

Referring to FIG. 5, wherein like reference characters indicate like parts as above, the rotor 1 may differ somewhat from the preceding examples. In this arrangement, yarn deflection is effected on an edge 17 which is formed by the inner groove surface 10 which is horizontal and a conical surface 6 which conical surface 6 also contains the openings 5 of the ducts 4. In this case, the annular conical projection is eliminated and a recess is formed instead within the rotor body. In addition, the yarn take-off tube 14 is set lower in such a manner that the deflection of the yarn on the edge 17 is rendered possible. This results in better propagation of the twist of the yarn spun into the collecting groove. In this arrangement, the groove radius R is 0.2 millimeters, the groove aperture angle $\alpha$ is 45°, the groove inclination angle $\beta$ is 22.5° and the yarn take-off angle $\gamma$ is 0°.

It has been found that the yarn quality and the take-off speed of the yarn from the rotor, or respectively, the trash deposition in the groove, depend on the following factors of influence determined by the groove geometry: the angle of aperture $\alpha$ of the fiber collecting groove, the angle $\beta$ of the bisector of the angle $\alpha$ with respect to the plane of rotation, the angle $\gamma$ under which the yarn is taken off from the groove and the radius R of the rotor groove. Thus, a large angle of aperture $\alpha$ i.e., between 45° and 90°, with the angle $\beta$ of groove inclination being in the range of 0 to $\alpha/2$, results in low trash depositions. A large groove radius R has a detrimental influence if the yarn take-off angle $\gamma$ is greater than zero. If, however, the angle $\gamma$ is about zero, the size of the radius R loses its influence on the trash deposition but not on the yarn strength. Yarn strength diminishes if R is large, as a flat sliver is generated which cannot be twisted into a strong yarn.

Comparative tests using the known rotors according to FIGS. 1 and 2 and using rotors according to FIGS. 3, 4 and 5, in which the above findings are considered yielded the following trash deposition values:

TABLE

Material processes: Turkish cotton, 1 1/16" staple. Trash containers of the input sliver: 0.12 to 0.2 percent. Duration of the spinning operation: 10 hours. Trash: milligrams (mg) per rotor.

| Rotor No. | Rotor according to FIG. | R (mm) | $\alpha$ | $\beta$ degrees | $\gamma$ | Trash (mg) |
|---|---|---|---|---|---|---|
| 1 | 1 | 0.8 | 35 | 42.5 | 25 | 113 |
| 2 | 1 | 0.2 | 35 | 42.5 | 25 | 16.7 |
| 3 | 2 | 0.8 | 45 | 22.5 | 20 | 16.8 |
| 4 | 3 | 0.2 | 75 | 15 | 17 | 2.6 |
| 5 | 4 | 0.2 | 45 | 22.5 | 17 | 2.3 |

-continued

| Rotor No. | Rotor according to FIG. | R (mm) | α | β degrees | γ | Trash (mg) |
|---|---|---|---|---|---|---|
| 6 | 5 | 0.8 | 45 | 22.5 | 0 | 2.8 |
| 7 | 5 | 0.2 | 45 | 22.5 | 0 | 3.8 |

The results given in the Table confirm that the trash quantity deposited in the rotor is a function of the angle α, β, γ and of the radius R.

The considerably smaller radius (0.2 mm) of rotor No. 2 as compared to the rotor No. 1 results in the substantial diminution of the trash deposit, the configuration of the other rotor characteristics remaining unchanged.

The angles α and β are chosen identical in the rotors Nos. 3 and 5, the angles γ, however, differing by 3° only. The rotor No. 3 with the radius R = 0.8 millimeters again shows a trash deposition many times greater than the rotor No. 5 with a radius R = 0.2 mm. This comparison also confirms that the smaller radius tends to accumulate less deposited trash. A positive influence on the results is noticed also by the feeble yarn take-off angle γ of the rotor No. 5.

The rotors No. 6 and No. 7 are chosen with the same angle α, β and γ; γ being reduced to the minimum angle of zero degrees. In this arrangement, trash deposition is no longer noticeably influenced by the difference in the groove radius R.

The rotors No. 1 and No. 3 are provided with the same groove radius R = 0.8 millimeters, they differ, however, considerably in the angle of aperture α of the groove and in the inclination of the bisector of the angle β. The larger angle α and the smaller angle β bring about a substantial diminution of the trash quantity accumulated.

The rotors No. 2 and No. 5 are provided with the same groove radius R = 0.2 millimeters, they differ, however, in the angles α and β. The larger angle α of the rotor No. 5 together with the smaller yarn take-off angle γ proves very advantageous in the trash deposition.

The rotor No. 4 also yields an excellent result. In this case, it should be noted that the yarn take-off angle γ of 17° and the angle γ of 15° almost coincide.

In summarizing, it should be noted that the trash deposition and the yarn quality depend on the factors α, β, γ and R.

Without endangering the low trash deposition, the angle of aperture α of the fiber collecting groove can be chosen in the range of 45° to 90°, the inclination β of the line *b* bisecting the angle of aperture α can be chosen in the range of zero to α/2, the yarn take-off angle γ in the range of 0° to 25°, and the groove radius R can be chosen in the range of 0.1 to 0.5 millimeters.

The rotor groove shape can also be realized in the same manner if exterior suction is used. In this arrangement, the rotor is not provided with ventilation ducts instead the air is sucked off via the clearance between the rotor cover and the rotor rim.

All dimensions mentioned in this description are to be considered with a margin of tolerance of 10 percent.

What is claimed is:

1. A rotor for an open-end spinning machine having a cavity concentrically disposed about a rotational axis;

a pair of annular intersecting surfaces within said cavity defining a fiber collecting groove at the largest inside diameter of said cavity;

a first angle of aperture between said surfaces of from 45° to 90°;

a rounded groove bottom of a radius from 0.1 to 0.5 millimeters between said surfaces;

a second angle between a straight line bisecting said first angle and a plane of rotation of said groove of a value from 0° to 45°;

a third angle between said plane of rotation and a yarn take-off direction from said groove of a value from 0° to 25°; and an annular edge sufficient to deflect a taken-off yarn between said fiber collecting groove and a yarn take-off tube.

2. A rotor as set forth in claim 1 wherein said first angle is 75°, said second angle is 15°. said third angle is 17° and said radius is 0.2 millimeters.

3. A rotor as set forth in claim 1 wherein said first angle is 45°, said second angle is 22 1/2°, said third angle is 17° and said radius is 0.2 millimeters.

4. A rotor as set forth in claim 1 wherein said first angle is 45°, said second angle is 22 1/2°, said third angle is zero and said radius is 0.2 millimeters.

5. A rotor as set forth in claim 1 wherein said axis is vertically disposed and said plane of rotation is a horizontal plane.

6. A rotor as set forth in claim 1 wherein one of said surfaces is perpendicular to said axis.

7. A rotor as set forth in claim 1 further having a conical annular portion concentrically within said groove and projecting through said plane of rotation of said groove, said conical portion having a flat annular surface and an outer peripheral edge about said annular surface defining said annular edge to deflect a taken-off yarn from said groove thereon.

8. In combination a rotor for an open-end spinning machine having a cavity concentrically disposed about a rotational axis; a pair of annular intersecting surfaces within said cavity defining a fiber collecting groove at the largest inside diameter of said cavity; first angle of aperture between said surfaces of from 45 to 90°; a rounded groove bottom of a radius from 0.1 to 0.5 millimeters between said surfaces; a second angle between a straight line bisecting said first angle and a plane of rotation of said groove of a value from 0 to 45°; and a third angle between said plane of rotation and a yarn take-off direction from said groove of a value from 0° to 25°;

a rotor cover having a yarn take-off tube projecting into said cavity coaxially of said axis; and an annular edge sufficient to deflect a taken-off yarn between said fiber collecting groove and said yarn take-off tube.

9. The combination as set forth in claim 8 wherein said tube projects through said plane of rotation of said groove.

10. The combination as set forth in claim 8 wherein said rotor has a conical annular portion concentrically within said groove and projecting through said plane of rotation of said groove, said conical portion having a flat annular surface and an outer peripheral edge about said annular surface defining said annular edge, and wherein said tube projects into said cavity a distance sufficient to deflect a taken-off yarn from said groove on said peripheral edge.

11. A rotor for an open-end spinning machine having
a cavity concentrically disposed about a rotational axis;
a pair of annular intersecting surfaces within said cavity defining a fiber collecting groove at the largest inside diameter of said cavity;
a first angle of aperture between said surfaces of 75°;
a rounded groove bottom of a radius 0.2 millimeters between said surfaces;
a second angle between a straight line bisecting said first angle and a plane of rotation of said groove of a value of 15°; and
a third angle between said plane of rotation and a yarn take-off direction from said groove of a value of 17°.

12. A rotor for an open-end spinning machine having
a cavity concentrically disposed about a rotational axis;
a pair of annulular intersecting surfaces within said cavity defining a fiber collecting groove at the largest inside diameter of said cavity;
a first angle of aperture between said surfaces of 45°;
a rounded groove bottom of a radius of 0.2 millimeters between said surfaces;
a second angle between a straight line bisecting said first angle and a plane of rotation of said groove of a value of 25½°; and
a third angle between said plane of rotation and a yarn take-off direction from said groove of a value of 17°.

13. A rotor for an open-end spinning machine having
a cavity concentrically disposed about a rotational axis;
a pair of annular intersecting surfaces within said cavity defining a fiber collecting groove at the largest inside diameter of said cavity;
a first angle of aperture between said surfaces of 45°;
a rounded groove bottom of a radius from 0.1 to 0.2 millimeters between said surfaces;
a second angle between a straight line bisecting said first angle and a plane of rotation of said groove of a value of 22½°; and
a third angle between said plane of rotation and a yarn take-off direction from said groove of a value of 0°.

* * * * *

UNITED STATES PATENT AND TRADEMARK OFFICE

CERTIFICATE OF CORRECTION

PATENT NO. : 4,058,964

DATED : November 22, 1977

INVENTOR(S) : Herbert Stalder

It is certified that error appears in the above-identified patent and that said Letters Patent are hereby corrected as shown below:

Column 1, line 57, after "i.e." delete --,--;
Column 1, line 58, change "tube" (second occurrence) to --yarn--;
Column 1, line 62, after "i.e." delete --,--;
Column 2, line 47, change "openend" to --open-end--;
Column 4,line 2, change second "The" to --This--;
Column 4, line 58, change "containers" to --contents--;
Column 5, line 35, change first "β" to --α--;
Column 5, line 46, change "γ" to --β--;
In the Claims
Column 6, line 18, after 15° change "." to --,--;
Column 7, line 21 change "annulular" to --annular--;
Column 8, line 5, change "25 1/2° to --22 1/2°--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*